United States Patent [19]

Liesse

[11] 4,200,213

[45] Apr. 29, 1980

[54] PERCUSSION APPARATUS

[75] Inventor: Maurice Liesse, Saint-Denis les Sens, France

[73] Assignee: Agence Nationale de Valorisation de la Recherche (ANVAR), Neuilly, France

[21] Appl. No.: 957,031

[22] Filed: Nov. 2, 1978

Related U.S. Application Data

[63] Continuation-in-part of Ser. No. 823,447, Aug. 10, 1977, abandoned.

[51] Int. Cl.[2] ..... B25C 1/08

[52] U.S. Cl. ..... 227/10; 60/633; 123/46 SC

[58] Field of Search ..... 60/632, 633; 123/46 SC, 123/48 A; 173/134, 135, 136, 137, 138; 227/9, 10

[56] References Cited

U.S. PATENT DOCUMENTS

| | | | |
|---|---|---|---|
| 2,898,893 | 8/1959 | Rohrer et al. | 227/10 X |
| 3,042,008 | 7/1962 | Liesse | 123/46 SC |
| 3,850,359 | 11/1974 | Obergfell | 227/10 |
| 3,967,771 | 7/1976 | Smith | 227/10 |
| 4,075,850 | 2/1978 | Nakazato et al. | 60/633 |

*Primary Examiner*—Paul A. Bell

*Attorney, Agent, or Firm*—Charles E. Brown

[57] ABSTRACT

A percussion apparatus, for example for driving nails or staples, having an auxiliary piston which when released thrusts a main operating piston to an intermediate position. The auxiliary piston transfers a metered quantity of gaseous fuel together with combustion supporting air to a space between the main piston and cylinder head separating the auxiliary piston cylinder from the main piston cylinder. The explosive mixture in the space is then ignited and the main piston is thrust in a first direction displacing a driver member and simultaneously the auxiliary piston is thrust in the opposite direction to its initial position where it is retained until released to start another operating cycle; the main piston automatically returns to its initial position as the combustion gases are exhausted to the atmosphere.

15 Claims, 13 Drawing Figures

26
39
25
60
55
65
66
71
58
PA
50
51A
43A
45
44
43
42
F14
F13
F12
F11
F10
30
29
32
40
36
80A
80
70
37
28

PERCUSSION APPARATUS

CROSS REFERENCE TO RELATED APPLICATION

The present application is a continuation-in-part application of my application Ser. No. 823,447, filed on Aug. 10, 1977 and now abandoned.

BACKGROUND OF THE INVENTION

The present invention relates generally to percussion machines or apparatus comprising a driver member driven by the expansion of gases following the ignition of an explosive mixture in a combustion chamber imparting powerful driving or striking movement to the driver member.

In this application, relative terms such as "top" or "upper", and "bottom" or "lower" are used with reference to a machine positioned as shown in the accompanying drawings. However, it will be evident that the machine will function in any desired orientation.

In a known type of such machines there is included a drive member adapted according to requirements and associated with an operating piston movable in a cylinder between a retracted position and an advanced position.

Various different ways of driving the operating piston have already been proposed; for example, systems which use compressed air as an energy source, devices driven by electricity, or the use of an explosive mixture introduced into the cylinder and adapted to powerfully drive the percussion member in such a manner that the latter operates effectively.

My U.S. Pat. No. 3,042,008 issued on July 3, 1962 describes a striking machine and the percussion machines of the type in which an explosive mixture is fired to produce the energy required to drive the driver member of the machine.

On the whole, such machines have been found to give satisfactory results, but certain difficulties have been encountered in their industrial development and manufacture for lack of a model which is suitable for wide-scale distribution and is both competitive and perfectly reliable.

SUMMARY OF THE INVENTION

An object of the present invention is such a percussion machine whose production and utilisation are substantially simplified in comparison with known machines of this kind, and which is also safe in operation.

According to the invention there is provided a percussion apparatus comprising a first housing, a main operating piston displaceable in said first housing from a rest position to a driven position and connected to a driver member; a second housing, an auxiliary piston displaceable in said second housing between a top and bottom end of stroke positions, retaining means for retaining said auxiliary piston in its top end of stroke position and actuating means for releasing said retaining means to initiate an operating cycle of said apparatus, means on said auxiliary piston for engaging said main operating piston to displace said main operating piston from its rest position to an intermediate position, a cylinder head disposed between said first and second housings and having an opening therethrough receiving said auxiliary piston and being closed thereby, air inlet means into said first housing for admitting combustion supporting air, said auxiliary piston defining a predetermined storage capacity for fuel and having means to transfer the fuel together with combustion supporting air to a space between said main operating piston in its intermediate position and said cylinder head in the course of its displacement between its top and bottom positions, the volume of said space being dependent upon the length of stroke of said auxiliary piston, ignition means for igniting the explosive mixture composed of the fuel and the combustion supporting air in said space when said auxiliary piston is in its bottom end of stroke position to thrust said main operating piston to its driven position and concomitantly return said auxiliary piston to its top end of stroke position, and exhaust means for evacuating exhaust gases produced by combustion of the explosive mixture.

According to a preferred feature of the invention, the auxiliary piston comprises internally, on one side of an axial valve known as the transfer valve, a metering chamber, and on the opposite side of the transfer valve, a buffer chamber which forms an intermediate space between the combustion chamber and the metering chamber.

Preferably, the transfer valve has a valve member which cooperates with a seat provided inside the auxiliary piston, and two operating rods extend from the transfer valve, one of which extends into the metering chamber for the purpose of controlling a valve for admitting fuel into the metering chamber, while the other extends into the buffer chamber and controls the opening of the transfer valve against the action of a spring of predetermined stiffness by cooperation with the main operating piston.

According to a further preferred feature of the invention, a so-called front terminal portion of the auxiliary piston cooperates with a central depression in the main operating piston, which depression is provided with a plurality of oriented passages, while the front terminal portion of the auxiliary piston is provided with suitably oriented passages, whereby creating considerable turbulence of the explosive mixture as it passes through the passages and the mixture which is admitted into the cumbustion chamber is thus homogeneous.

According to a further preferred feature of the invention, the buffer chamber contains a non-return valve which prevents burned gases from rising into the metering chamber.

The percussion apparatus embodying the present invention is suitable for simple, enonomical production; its use is very simple in operation because by merely operating a trigger or push-button a complete operating cycle is performed, while after operation the apparatus will resume its original position ready for a further complete cycle. The apparatus is therefore practically at all times in operating condition.

These features are made possible essentially by the auxiliary piston which serves various main functions, namely: metering of a volume of gas at top end of stroke position; mixing of an explosive mixture by admission of air when the auxiliary piston descends toward its bottom end of stroke position; formation of the explosive mixture in a combustion chamber which is produced by the downward movement of the main piston, the downward movement of the main piston being caused by the auxiliary piston driving the main piston downwards to its intermediate position; automatic return to the initial locked position of the auxiliary piston as the result of the explosion in the combustion chamber.

It will be understood that the apparatus according to the present invention is capable of various applications. Indeed the driver member may operate various kinds of tools which would be secured to or integral with the driver member for movement therewith, such as marking or branding tools, punching tools, chiseling tools, fastener drivers for other types of fasteners such as nails, studs or rivets, and in general all tools or operating members which require repeated percussion or impacting blows.

Nevertheless, by way of an example of application, an embodiment of the invention is illustrated and described below with reference to a percussion apparatus which is constructed and arranged to operate as a stapling machine.

The stapling machine embodying the invention is capable of exceptional performances, from the standpoints of stapling rates, work capacity, compactness and maneuverability. Tests have also demonstrated that such a machine is particularly reliable in operation.

The description of the present invention in respect to a stapling machine given by way of example is not intended to be restrictive.

Other features and advantages of the present invention will be brought out in the description which follows with reference to the accompanying drawings.

DESCRIPTION OF PREFERRED EMBODIMENTS

Figure 1:
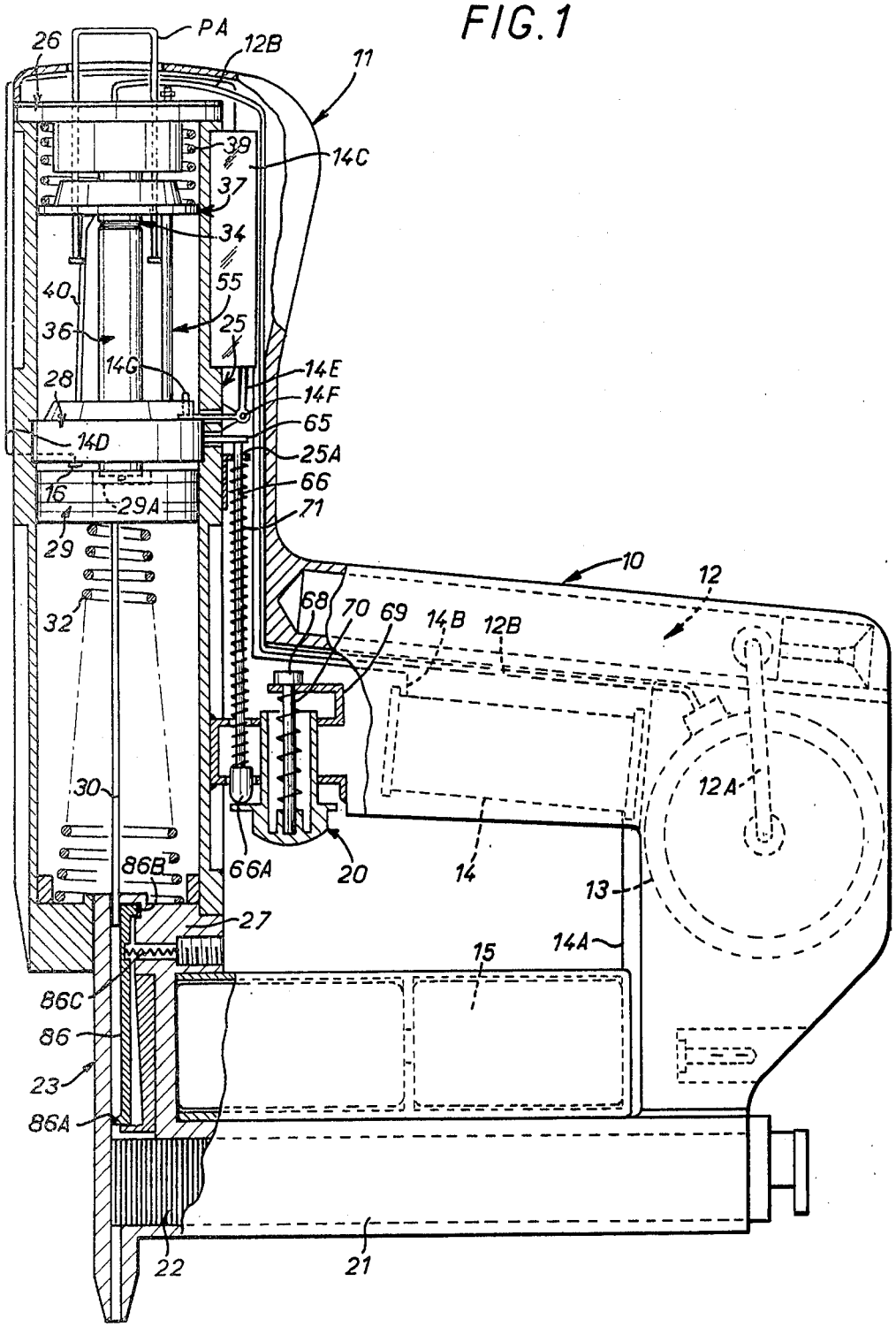
FIG. 1 shows in elevation and partly in section a percussion apparatus embodying the invention as applied to a stapling machine.

In the embodiment illustrated in FIG. 1, the machine comprises a part 10 forming a grippable handle and, associated with the latter, a longitudinal member 11 comprising in particular a driver member and its operating mechanism.

Part 10 is constructed to accommodate the other parts including a gas reservoir 12 connected by a tube 12A to an adjustable pressure reducing valve 13. The gas reservoir 12 is preferably of the rechargeable type for accommodating a gas cartridge containing a gas such as butane or propane at a pressure of 6 to 8 kg in the case of propane and 1 to 3 kg in the case of butane. It should be noted that at the outlet side of the adjustable pressure reducing valve 13 the pressure is between 0.2 kg and 1 kg depending on the capacity of the combustion chamber.

The part 10 also houses an ignition coil 14 connected by a conductor 14A to a source of electrical energy comprising a battery 15 and by conductor 14B to a housed vibratory switch 14C of the type disclosed in my U.S. Pat. No. 3,193,642 issued on July 6, 1965 and incorporated by reference into the present application. Conductor 14D carries ignition current to igniter 16 from the vibratory switch 14C. The vibratory switch 14C is actuated by a lever 14E pivoted at 14F and operated by feeler member 14G slidably mounted in the cylinder head 28 and adapted to be depressed by the downwardly moving auxiliary piston 37 as will be described below.

The part 10 also contains an operating push-button indicated generally by the reference 20, and is also adapted to form a magazine 21 for staples, or the like 22, leading into a stapling head indicated generally by 23 and forming a driving-in guide.

The longitudinal member 11 comprises a cylinder 25 closed at its ends by end pieces 26 and 27 respectively; internally the cylinder is equipped with a fixed cylinder head 28 which divides the cylinder into a lower first housing 25A and an upper second housing 25B. The first housing contains a main operating piston 29 with which a driver member 30 is associated.

Between the main operating piston 29 and the end piece 27 the first housing of the cylinder 25 contains a spiral spring 32 of which one end bears against the main piston 29 and of which the other end bears against the end piece 27; the main piston 29 is capable of rapid reciprocating axial displacement through the action of an operating means indicated generally by 34. Operating means 34 drives the main piston 29, and consequently the driver member 30, from a first rest position to a second activated position in the course of which a fastener, such as a staple 22 is extracted from the magazine 21 and driven out of the stapling head, after which the spring 32 returns the main piston and drive member to the first rest position so that they will be ready for a new cycle.

Figure 2:
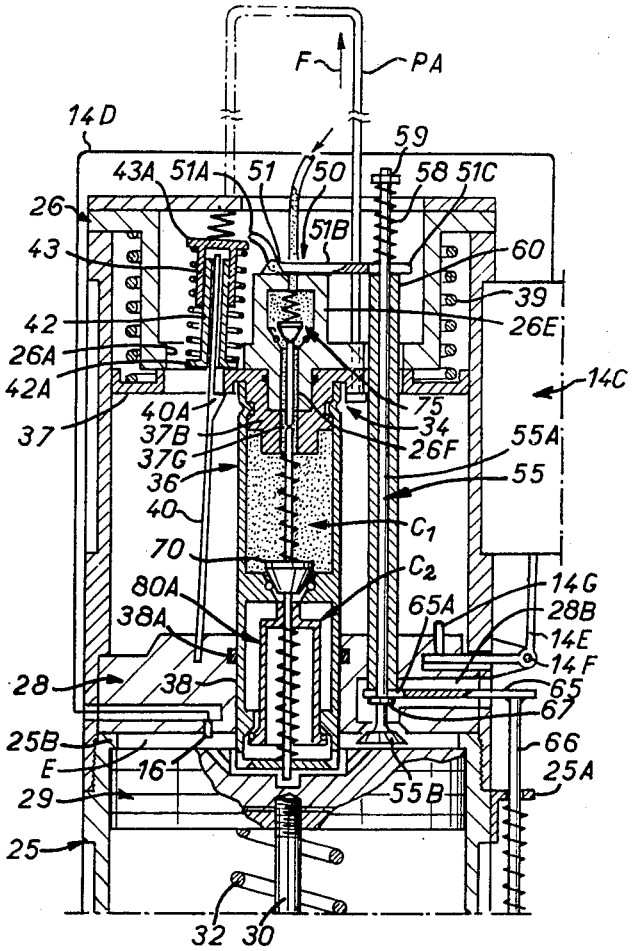
FIG. 2 shows an elevation, in section, of the operating mechanism for actuating the main piston of FIG. 1, including the auxiliary piston, this mechanism being shown in its retracted or rest position.

As shown more clearly in FIG. 2, the operating mechanism 34, which is housed in an upper or second housing of the cylinder 25, comprises an arrangement formed of a secondary or auxiliary piston 36, which is coaxial with the axis of the cylinder and with which a disc 37 is associated at the top part the disc having an upper boss sealingly engaging the auxiliary piston; the auxiliary piston is adapted to slide in a bore 38 provided in the cylinder head 28 and equipped with seals 38A, while a spring 39 interposed between the aforesaid disc 37 and the end piece 27 urges the disc downwards. An actuator handle PA projecting out of the cylinder is associated with the disc 37 and consequently with the auxiliary piston 36, since the latter is connected to the disc; this handle is freely slidable through the disc because of holes provided for this purpose.

Figure 3:
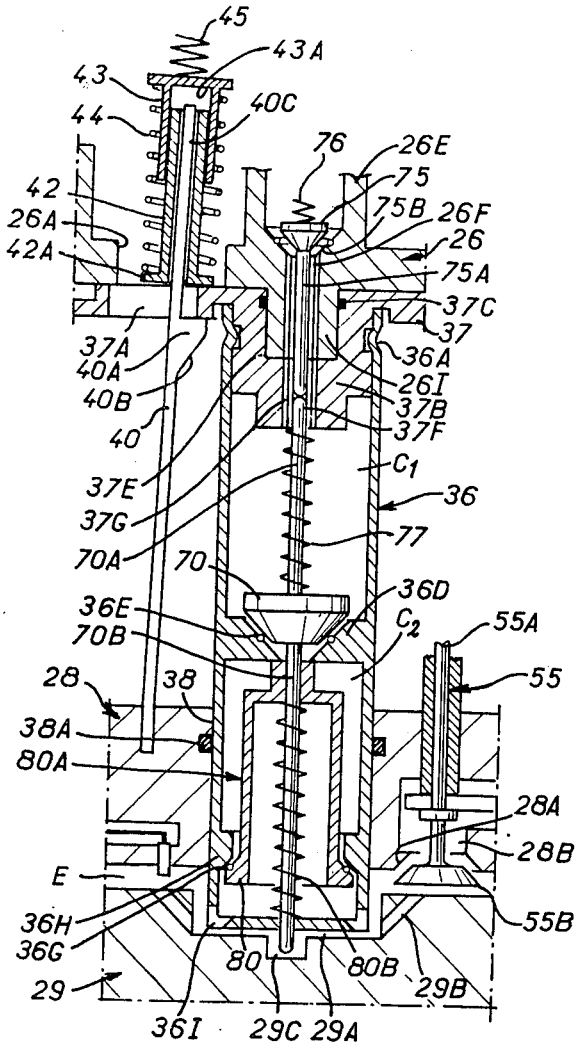
FIG. 3 is a detailed view on a larger scale and in section of the auxiliary piston of FIG. 2.

When the machine is at rest but activated and ready for operation, the various parts are thus in the position shown in FIGS. 1 to 3. In these figures the auxiliary piston 36 is in the upper end of stroke position; it is held in that position by a crutch 40 of spring material, connected at the bottom to the cylinder head 28. This crutch comprises (see in particular FIGS. 2 and 3) an abutment formed by a shoulder 40A having a sloping portion 40B adapted to cooperate with the disc 37; beyond this abutment the crutch is provided with an extension 40C. On this extension engages a first sleeve 42 known as the bottom sleeve, which rests by a collar 42A on the disc 37, extending through a passage 26A provided in the cylinder end piece 26; the bottom sleeve 42 receives a second sleeve 43, known as the upper sleeve and having a collar 43A. A first spring 44 bears by its ends on these collars, which are disposed between the collar 43A of the upper sleeve and the end piece 26 of the cylinder.

The first spring 44 serves to move the two sleeves 42 and 43 away from each other, while the purpose of the second spring 45 is to apply thrust to the two sleeves through the first spring 44, so that the sleeve 42 bears by its collar 42A against a corresponding face of the disc 37 when, as in the case shown in FIGS. 1 to 3, the auxiliary piston is in the upper end of stroke position.

It should be noted that the opening 26A provided in the end piece 26 of the cylinder and the opening 37A provided in the disc 37 permits the passage of the extension 40C of the crutch provided with sleeves 42 and 43 and spring 44 as will be brought out in the description of the operation of the apparatus hereinafter; the aforesaid openings, however, have another function which is to define a passageway for the admission of air into the cylinder in order to constitute an explosive mixture in the combustion chamber.

Externally, the end piece 26 of the cylinder is provided with a boss 26E which carries a motion transmission member in the form of a fork 50 mounted for pivoting about a pin 51 and having branches 51A, 51B extending to either side of the pin.

Figure 4:
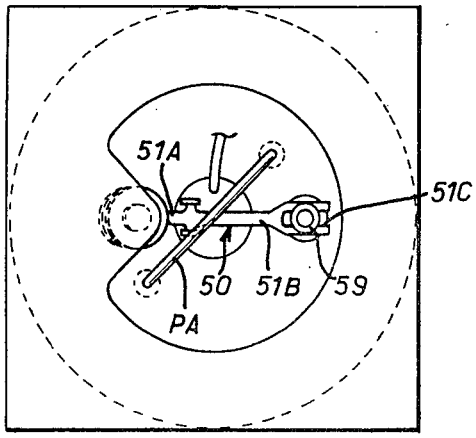
FIG. 4 is a plan view of FIG. 2.

The branch 51A forms a control lever adapted to cooperate with the collar 43A of the upper sleeve 43, while at its free end portion the branch 51B has an opening 51C (FIG. 4) for the passage of the end portion of the rod 55A of a valve indicated generally at 55.

This valve comprises in the usual manner a valve member 55B intended to cooperate with a seat 28A provided in the fixed cylinder head 28, while a passage 28B leading to the outside is likewise provided in this cylinder head for the evacuation of combustion gases.

The rod 55A therefore tends through the cylinder head 28 to a point beyond the outer face of the end piece 26; the valve 55 is urged into the closed position by means of a spring 58 interposed between a ring 59 and the branch 51B of the fork. A sleeve 60 is engaged on the rod 55A of the valve; its length is such that one of its ends is in contact with the branch 51B of the fork 51, passing through apertures provided respectively in the disc 37 and in the end piece 26 of the cylinder, while the other end extends into the exhaust passage 28B. The exhaust valve 55 is therefore guided through the sleeve 60 at two points situated near the valve head and at the end portion of the valve rod.

In the exhaust passage 28B there is disposed an operating finger 65 (shown more clearly in FIGS. 1, 2 and 5 to 9) connected at one end to an operating lever 66 extending along the cylinder, while the other end is adapted to cooperate with the push-button 20.

The operating finger 65 is engaged by means of an end slot 65A on the valve rod near the valve head, between a shoulder 67 provided on the valve rod and the corresponding end of the sleeve 60.

The push-button 20 (FIG. 1) is associated by means of a screw 68 with a projection 69 provided on the cylinder 25 and is adapted to slide in the projection; it is subjected to the action of the spring 70 urging it downwards; a spring 71 is engaged on the lever 66, this spring being slightly more powerful than the spring 58 associated with the valve 55, and by one end it bears against an abutment 25A fixed laterally on the cylinder 25, while its other end bears against a terminal boss 66A of the lever 66, this boss being in addition intended to cooperate with the push-button 20.

Thus, starting from the push-button 20 the lever 66 together with operating finger 65, sleeve 60, and fork 50 forms a linkage adapted to release the crutch 40 and also insure the closure of the exhaust valve 55; the closing off of the exhaust valve occurs simultaneously with the release of the crutch 40 or slightly before the same, the fork 50 being suitably contoured for this purpose.

With regard to the auxiliary piston 36, this extends coaxially to the axis of the cylinder 25 and has a rear end portion coupled to the disc 37 and a front end portion facing the main operating piston 29.

At its rear end position the auxiliary piston 36 is connected, advantageously by necking-in, at 36A to a boss 37B provided for the purpose on a face of the disc 37.

Internally the boss 37B has a blind hole 37E in which, when the auxiliary piston is in its upper end of stroke position, a boss 26I is engaged which is provided on the bottom face of the end piece 26; a seal 37C is disposed in the vicinity of blind hole 37E in order to provide sealing between the blind hole and the boss 26I and the end piece 26. Inside the auxiliary piston is a first chamber C1, referred to hereinafter as a metering chamber, which is separated from a second chamber C2, referred to as a buffer chamber, by a transfer valve having a valve member 70 adapted to cooperate with the interposition of a seal 36E.

Two operating rods 70A and 70B extend to opposite sides of the valve member 70; the rod 70A extends through the chamber C1 in the rear portion of the auxiliary piston, while the rod 70B extends through the chamber C2 in the front portion.

The free end of the rod 70A is intended to cooperate with a corresponding end of the stem 75A of another valve, which is known as the admission valve and which is adapted to move axially inside the boss 26I and has a valve member 75 adapted to cooperate with a seat 75B provided in the boss 26E in the end piece 26 of the cylinder.

The stem 75A of the admission valve is mounted for sliding in the end piece 26 and in its boss 26I with the aid of a bore 26F; it is also mounted for sliding in the boss 37B with the aid of a bore 37G. The bores 26F, 37B each have an inner surface comprising longitudinal grooves adapted to form guide means for the rods of the transfer and admission valves. The longitudinal grooves in the bosses 26F and 37B have the dual function of admitting fuel, and air from the surroundings, to the interior of the auxiliary piston. The admission valve member 75 is in addition subjected to the action of a spring 76 urging it back onto its seat 75B.

It will be observed that the valve member 70 of the transfer valve is likewise subjected to the action of a spring 77 urging it back towards its seat 36D.

The buffer chamber C2 contains a valve, known as check valve, with a seat 36G provided in a boss 36H inside the auxiliary piston, and also having a valve member 80 formed at the end portion of a bell-shaped part 80A adapted to slide on the rod 70B; the bell-shaped part 80A is subjected to the action of a spring 80B urging the valve member 80 onto its seat 36G.

It should be made clear at once that the spring 80B is weaker than the spring 77, which is turn is considerably weaker than the spring 76.

The front end portion of the auxiliary piston 36 is provided with distribution means for the explosive mixture, these means consisting of a plurality of holes 36I whose axes are downwardly divergent with respect to the axis of the auxiliary piston, in other words, directed towards the passages 29B.

The usefulness of an arrangement of this kind will be clear from the description of the operation of the machine.

As shown in FIG. 3, the main operating piston 29 is provided in a central zone with a circular depression 29A into the interior of which a plurality of passages 29B lead, these passages being intended to establish communication between the said depression and a space E provided between the cylinder head 28 and the main operating piston 29. These holes 36J are also formed with their respective axes oriented so that the jets of the explosive mixture passing through the holes criss-cross in the space E.

At the center of the depression 29A is provided a recess 29C adapted to cooperate with the free end of the rod 70B.

Figure 13:
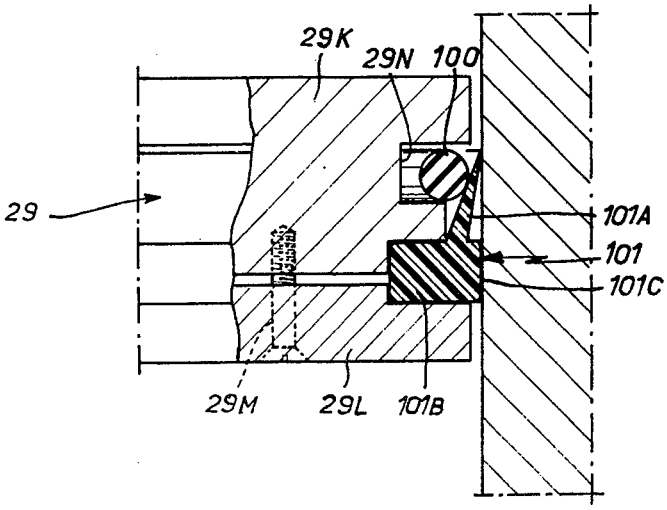
FIG. 13 shows in section on, an enlarged scale, a sealing member for the main operating piston.

Preferably the main operating piston 29 is equipped with a sealing member as illustrated in FIG. 13. To this end the main operating piston 29 is formed in two parts 29K and 29L fastened together with a screw 29M or an equivalent fastener. Part 29K comprises an annular groove 29N in which an O-ring 100 of elastically deformable material such as rubber is housed. The O-ring 100 is freely mounted in the groove 29N and acts radially outwardly as an expansion member bearing against a peripheral lip 101A of an annular seal designated overall by reference 101 comprising a heel portion 101B held captive between parts 29A and 29B of the main operating piston 29.

The sealing member 101 is formed of self-lubricating material, for example graphite impregnated Teflon so that separate lubricating means can be dispensed with. The lipped seal 101 acts in the usual fashion but the O-ring 100 ensures that the lip 101A is not unduly stressed or thrust in response to the exploding of the explosive mixture in the combustion chamber. In addition the heel portion 101B of the seal 101 also has a cylindrical outer surface 101C adapted to be in contact with the inner wall of the cylinder and thereby tends to guide the main operating piston 29 therein.

It will be understood that such a sealing member is also entirely suitable for use in place of the sealing members 38A in which case a single such sealing member will suffice. In such a case it will, however, be necessary to provide an O-ring which acts in compression if the sealing member is to be housed in the cylinder head 28 receiving the auxiliary piston 36.

The operation of the machine described above may be analysed as follows.

On starting up, the machine for example not being activated, the auxiliary piston 36 is in its lower end of stroke position; it is therefore necessary to bring the auxiliary piston 36 to its upper end of stroke position, for which purpose traction is applied (arrow F, FIG. 2) to the actuator handle PA.

After this operation the various members of the mechanism are in their positions as illustrated in FIG. 2, that is to say:

the main operating piston 29, and consequently the driver member 30, are in their upper positions, the upper position of the operating piston being determined by a circular ledge 25B provided inside the cylinder 25, so as to form the aforesaid space E between the main operating piston and the corresponding face of the cylinder head;

the auxiliary piston 36 is in the upper end of stroke position, where it is retained by the associated crutch 40 locking the disc 37;

the branch 51B of the fork 50 bears against the top of the boss 26E of the cylinder;

the valve 55 is in the open position because the spring 71 is slightly more powerful than the spring 58 tending to close the valve;

the admission valve member 75 is opened by the operating rod 70A, thus permitting the admission through the passages 26F and 37G of a certain amount of fuel entering the boss 26E from the pressure reducing valve into the metering chamber C1, where it is confined because the transfer valve 70 is in the closed position due to the action of the spring 77; and no force is applied to the push-button 20.

When (FIG. 5) the push-button 20 is pushed in the direction of the arrow F2, the position of the various members becomes as follows:

the upward displacement of the finger 65 of the operating lever 66 brings about the displacement of the sleeve 60 in the direction of the arrow F3, which has the effect of:

(a) closing the valve 55 by means of the spring 58;

(b) causing the fork 50 to rock in the direction of the arrow F4.

As a result of the rocking of the fork 50 the branch 51A forming a control lever bears against the collar 43A of the upper sleeve 43, thus causing the displacement of the sleeve (arrow F5) and also of the crutch 40 in the direction of the arrow F6.

Displacement of the crutch 40 and of its abutment 40A frees the disc 37 and consequently the auxiliary piston 36 associated therewith, all of which through the action of the spring 39 descends abruptly in the direction of the main piston 29.

Figure 6:
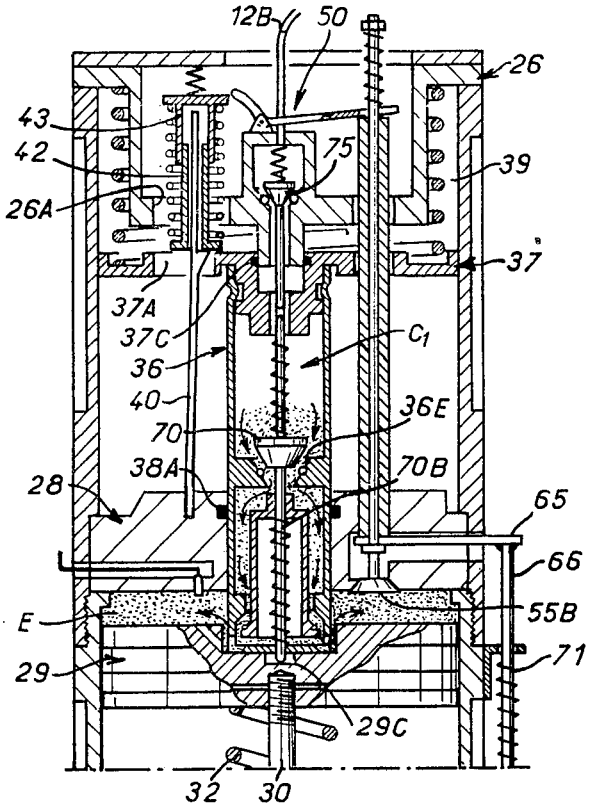

The displacement of the auxiliary piston 36 from its upper end of stroke position toward its lower end of stroke position has the following effect (FIG. 6, illustrating an intermediate position):

(a) closing the gas admission valve 75 as soon as the disc 37 has moved away from the cylinder end piece 26, thus interrupting the feeding of fuel; gas being fed through tube 12B connected at one end to adjustable pressure reducing valve 13 and the other to the boss 26E;

(b) moving the valve member 70 of the transfer valve away from its seat 36D because the end of the rod 70B has come into contact with the central recess 29C in the main operating piston 29;

(c) effecting the transfer of the fuel from the metering chamber C1 to the aforesaid space E; which transfer is accomplished by the pressure of gaseous fuel in the metering chamber, the pressure causing the opening of non-return valve 80 due to spring 80A biasing it to its closed position being very weak and therefore offering only slight resistance easily overcome by the fuel.

The explosion of the explosive mixture in the combustion chamber causes the following (as shown in FIGS):

(a) pushing the non-return valve 80 against its seat 36G in order to prevent the gases produced by the explosion from penetrating into the chambers C2 and C1;

(b) bringing about the rapid upward movement of the auxiliary piston 36 and locking it in its upper end of stroke position because the disc 37 is again bearing against the abutment 40A of the crutch 40 after the latter has been rocked through the action of the sloping surface 40B, and also because the driver member momentarily bears against the projecting portion 86A of the element 86;

(c) the main piston 29 is now released to continue its downward movement after the element 86 has been pushed aside. The main piston, being thrust violently downwards (FIG. 8), drives the associated driver member 30 against the action of the spring 32;

(d) it will be noted that in the intermediate position illustrated in FIG. 6, the fuel is transferred, for the most part, into space E on its own, without any combustion-supporting air from the surroundings, owing to the fact that the seal 37C mounted at the upper end of bore 37E formed in the disc 37 prevents air from entering the interior of the apparatus. Accordingly, owing to this arrangement, there is first transfer of the fuel from the metering chamber C1 into space E and then admission of air from the surroundings once the seal between the bottom of the end piece 26 and the disc 37 is broken as shown in FIG. 7.

Figure 7:
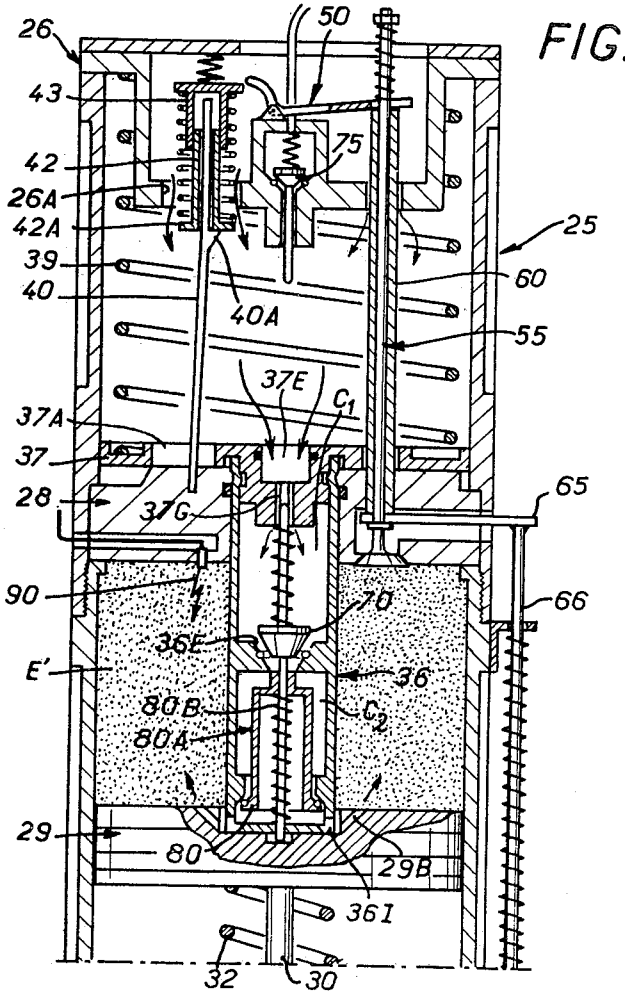
FIGS. 5 to 9 are view similar to FIG. 2, illustrating an operating cycle of the machine.
Figure 5:
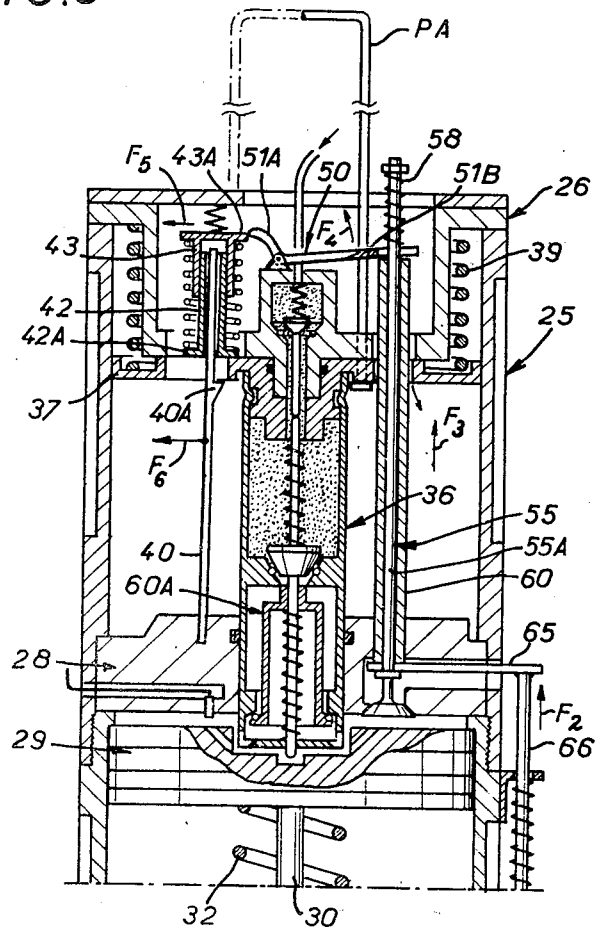

In FIG. 7 the auxiliary piston is in its bottom end of stroke position and the space E′ is filled with explosive mixture because in the course of the descent of auxiliary piston 36 the sealing effect is broken between the end piece 36 and the disc 37 thereby permitting the admission of air from the surroundings. The incoming air which is sucked in by the descending auxiliary piston 36 has a scavenging effect given the negative pressure caused by the quick displacement of the auxiliary piston. The air enters the interior of the apparatus through passages 26A in the end piece 26, and passages 37A formed in the disc 37 and grooves 37G running through the disc 37.

Thus a homogenous mixture of the explosive mixture is produced due to the air drawn in and the arrangement of the passages 36I, 29B respectively defined in the lower end of the auxiliary piston 36 and in the depression 29A in the main operating piston 29 which causes considerable turbulence.

At this stage the auxiliary piston is in its lower position and the explosive mixture fills the space E′ forming the combustion chamber; simultaneously, the bottom end of the driver member 30 tips projection 86A formed at one end of a retractable place 86 inserted in the stapling head 23 midway along its downstroke thereby offering temporary resistance to its descent. The other end of the plate 86 is mounted for rocking at 86B, and biased by a spring 86C in an intermediate zone to the illustrated position. Alternatively the plate 86 may be returned automatically to its retracted position when the auxiliary piston is at the top end of its stroke position by means of a suitable linkage (not shown) including a drawbar connected to the plate 86.

The purpose of the retractable plate 86 will now be described. When the disc 37-auxiliary piston 36 combination is in its lower end of stroke position, the sensing finger 14G is depressed in the cylinder head 28 causing the rocking of lever 14E, the actuation of the vibrating switch and the sparking (represented at 90) of igniter 16 which ignites the explosive mixture.

The projecting portion 86A on the retractable plate 86 is then operative to permit the continued descent of the driver member 30 when the thrust it exerts exceeds a predetermined minimum value which is a function of the configuration of the retractable plate 86 and the stiffness of spring 86C. The minimum permissible pressure may for example be of the order of 6 to 8 kg/cm$^2$ which ensures that the driver member does not strike the staple at the end of the magazine 21 until the thrust has attained the desired value. Such a retractable plate 86 is particularly useful if the explosive misture is slow burning or if the main operating piston 29 is of light-weight construction to prevent premature striking. The retractable plate 86 thus acts as thrust regulating means. When operating outside such operating conditions it is possible to dispense with the retractable plate entirely.

When the main piston has reached its lower end of stroke position (FIG. 8) the staple, in the illustrated embodiment is expelled from the stapling head 23 and the main piston 29 then rises spontaneously to its initial position through the action of the spring 32. This return movement of the piston 29 against the pressure exerted in space E is permitted by the opening of exhaust valve by spring 71 when push-button 20 is released.

Figures 8, 9, 10, 11:
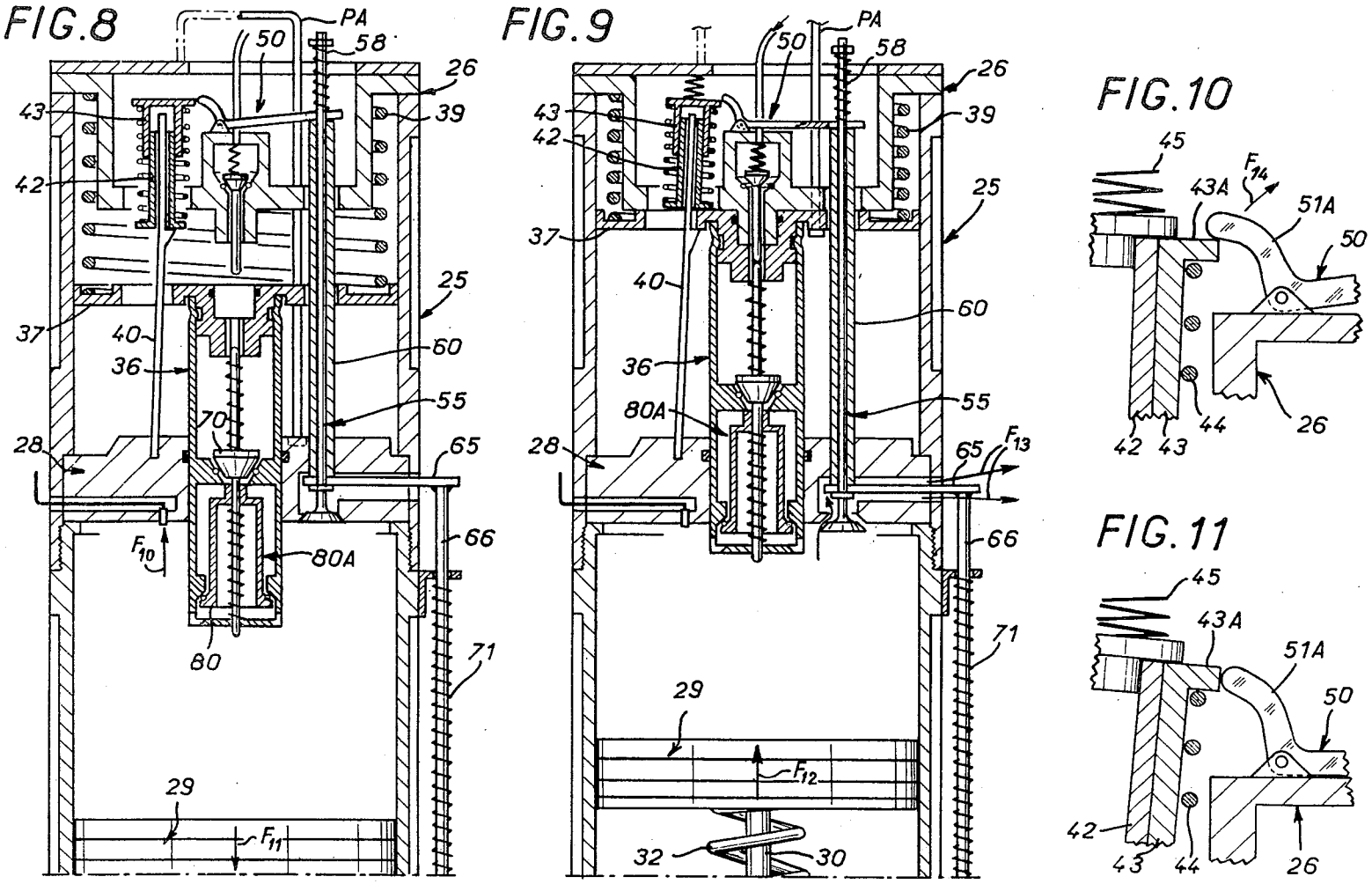
FIG. 10 and 11 are partial view of the mechanism shown in FIG. 2.

In FIG. 8 the auxiliary piston 36 has been shown in the course of its upward movement. Whereas the main operating piston 29 is in its lower end of stroke position.

When the push-button 20 is released the valve 55 (FIG. 9), which until that moment was in the closed position, is brought to the open position permitting the evacuation of the gases (arrow F12) to the outside by way of the passages 28B, this evacuation being assisted by the rising of the main piston.

One operating cycle having been completed, all the parts are in the rest position ready for a new cycle, that is to say, in the position shown in FIG. 1.

Fully automatic operation, one stroke after another is thus obtained.

It should be noted that if the operator were to maintain pressure on the push-button 20 for too long a time, the interlocking of the auxiliary piston 36 in its upper end of stroke position is not thereby prevented.

Assuming in fact that the fork 50 is held in the rocked position by pressure of the push-button, as shown in FIGS. 10 and 11, the disc 37 will nevertheless be reengaged by bearing against the abutment 40A owing to the fact that at the end of the upward movement of the disc, the sleeves 42, 43, which were bearing against this abutment (FIG. 8), are pushed upwards by the disc 37; since the branch 51A of the fork 51 is not retracted, the collar 43A of the upper sleeve 43 will come to bear against the bottom face of the branch 51A, which has the effect of slightly compressing the spring 44.

When the fork 50 is freed (pressure exerted on the push-button 20 being released) it assumes its initial position by rocking in the direction of the arrow F14 (FIG. 10), which has the effect of releasing the collar 43A of the sleeve 43 which, being thus in turn freed, also returns to its initial position under the action of the spring 44.

It should be observed that as long as the fork 50 has not returned to its initial position a cycle cannot be commenced owing to the fact that action on the push-button 20 would have no effect on the fork 50, which would remain in the position shown in FIG. 10.

Furthermore, in the event of pressure on the button being released before the end of the operating cycle, this cycle would not be disturbed thereby although the exhaust valve would be urged to its open position. The volume of explosive mixture contained in the chamber E′ and the small space provided between the head 55B of the exhaust valve and its seat 28A are in fact such that as soon as firing has been effected the valve head is subjected to pressure such that it is closed, pushing back the operating finger 65, so that the boss 66A of the push-bottom is accordingly moved away to the rest position.

Figure 12:
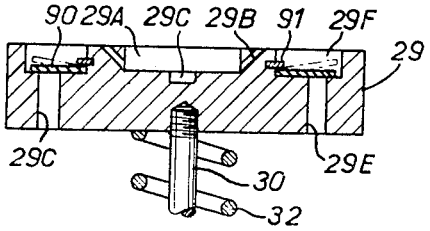
FIG. 12 shows an alternative embodiment of the main operating piston.

As can be seen in FIG. 12, the main operating piston 29 may be provided with one or more passages 29E for the introduction of additional air to the combustion chamber; these passages are closed on the side situated towards the cylinder head by a deformable flat seal 90 disposed in a circular groove 29F and secured by a retaining ring or circlip 91.

The introduction of additional air into the combustion chamber is effected in the course of the operating phase during which under the action of the axial displacement of the auxiliary piston 36 the main operating piston 29 moves from its upper end of stroke position (FIG. 5) to its lower end of stroke position (FIG. 7) in which the space E' forms the combustion chamber in which the explosive mixture is confined.

In the course of the displacement of the main piston 29 the flat seal 90 is in fact deformed by the pressure of the air situated between the main operating piston and the cylinder end piece 27, which is able to bring the compartment accommodating the spring 32 into communication with the atmosphere.

The invention is obviously not limited to the embodiment selected and illustrated, which on the contrary admits of various modifications without departing from the scope of the present invention as defined by the appended claims.

In particular the driver member may be attached to and sort of tool or operating member for carrying out a myriad of functions wherever a repeating percussion or impact effect is required.

What I claim is

1. A percussion apparatus comprising a first housing, a main operating piston displaceable in said first housing from a rest position to a driven position and connected to a driver member; a second housing, an auxiliary piston displaceable in said second housing between a top and bottom end of stroke positions, retaining means for retaining said auxiliary piston in its top end of stroke position and actuating means for releasing said retaining means to initiate an operating cycle of said apparatus, means on said auxiliary piston for engaging said main operating piston to displace said main operating piston from its rest position to an intermediate position, a cylinder head disposed between said first and second housings and having an opening therethrough receiving said auxiliary piston and being closed thereby, air inlet means into said first housing for admitting combustion supporting air, said auxiliary piston defining a predetermined storage capacity for fuel and having means to transfer the fuel together with combustion supporting air to a space between said main operating piston in its intermediate position and said cylinder head in the course of its displacement between its top and bottom positions, the volume of said space being dependent upon the length of stroke of said auxiliary piston, ignition means for igniting the explosive mixture composed of the fuel and the combustion supporting air in said space when said auxiliary piston is in its bottom end of stroke position to thrust said main operating piston to its driven position and concomitantly return said auxiliary piston to its top end of stroke position, and exhaust means for evacuating exhaust gases produced by combustion of the explosive mixture.

2. Apparatus according to claim 1, wherein said auxiliary piston has axially spaced metering and buffer chambers, a transfer valve controlling communication between said chambers, the metering chamber being on the side of said transfer valve remote from said main operating piston and said buffer chamber being on the side of said transfer valve adjacent said main operating piston, said transfer valve being axially displaceable between a closed position in which said chambers are isolated from each other when said auxiliary piston is retained in its top end of stroke position and an open position in which said chambers are brought in communication with each other when said auxiliary piston moves to its bottom end of stroke position, a fuel supply passage for supplying fuel to said metering chamber, a fuel supply valve in said fuel supply passage for controlling fuel flow through said fuel supply passage, means on said transfer valve being operable to control said fuel supply valve for controlling the supply of fuel to said metering chamber and non-return valve means provided in said buffer chamber.

3. Apparatus according to claim 2, wherein a front end portion of said auxiliary piston is cooperable with said main operating piston and has a series of passages for bringing the interior of said buffer chamber into communication with said space between said cylinder head and said main operating piston and for producing turbulent flow of explosive mixture.

4. Apparatus according to claim 2, wherein said main operating piston has a face facing said cylinder head, and having a central depression with a plurality of passages for bringing said depression into communication with said space between said cylinder head and said main piston and for producing turbulent flow whereby the fuel is intimately mixed with combustion supporting air.

5. Apparatus according to claim 2, wherein said main operating piston has passages for admission of combustion supporting air to said space, deformable seals for closing said passages; and wherein said auxiliary piston has a rear portion on the fuel supply side which is sealed off by a boss when said auxiliary piston is in its top end of stroke position.

6. Apparatus according to claim 2, wherein said retaining means comprises a disc associated with a rear portion of said auxiliary piston and urged by a spring towards said main operating piston, and a crutch movable between an operative position in which the disc is locked and the spring compressed so that said auxiliary piston is retained in its upper end of stroke position, and a retracted position in which said auxiliary piston is abruptly freed for displacement to its lower end of stroke position by means of said spring.

7. Apparatus according to claim 6, further comprising a manually actuated linkage including for moving said crutch between its operative position to its retracted position and opening and closing said means for evacuating gases a push-button, said linkage being associated with said push-button and including an operating finger in engagement with a valve rod of said means for evacuating gases, a first spring for biasing said valve rod towards its closed position, and another spring acting against and stronger than said first spring acting on said push-button.

8. Apparatus according to claim 7, wherein there is a transmission member, said spring associated with said means for evacuating exhaust gases cooperates with said transmission member to urge the same towards an inoperative position and at the same time urges said means for evacuating exhaust gases to its closed position, said transmission member comprising a fork with two branches one of which is held captive between a spring and said exhaust valve rod and the other being shaped to cooperate with means associated with said crutch.

9. Apparatus according to claim 7, wherein said crutch is formed of a rod of resilient material one end of which is fixed to said cylinder head while the other end is adapted to cooperate with said second branch of said transmission member by two collared sleeves engaged head to tail on said crutch with a spring interposed therebetween, an upper one of said sleeves cooperating with said second branch of said transmission member and being resiliently biased.

10. Apparatus according to claim 9, further comprising plural passages in an upper cylinder end piece for admission of combustion supporting air, one through which said exhaust valve rod extends and a second through which said crutch extends.

11. Apparatus according to claim 3, wherein said fuel supply valve is disposed in a chamber in an upper cylinder end piece, said fuel supply valve being controlled by movement of said auxiliary piston from its top end of stroke position to its bottom end of stroke position.

12. Apparatus according to claim 2, said driver member being a fastener driver further comprising a magazine for fasteners of the type including staples, nails or the like leading into a guide from which they are ejected by said fastener driver, and a resilient biased plate housed in said guide offering temporary resistance to the descent of the fastener driver from said intermediate position.

13. Apparatus according to claim 1, further comprising means for preventing completion of the downward stroke of said driver member until the thrust it exerts exceeds a predetermined minimum value.

14. Apparatus according to claim 1, an air flow path between said air inlet means and the storage capacity defined in said auxiliary piston including sealing means for preventing the entry of air from the air inlet means into the storage capacity until a substantial proportion of fuel has been transferred from the storage capacity to said space.

15. Apparatus according to claim 14, wherein said sealing means is operatively interposed between a fixed end piece and a disc forming part of said auxiliary piston.

* * * * *